US006276987B1

(12) United States Patent
Li et al.

(10) Patent No.: US 6,276,987 B1
(45) **Date of Patent: *Aug. 21, 2001**

(54) CHEMICAL MECHANICAL POLISHING ENDPOINT PROCESS CONTROL

(75) Inventors: Leping Li, Poughkeepsie, NY (US); James A. Gilhooly, Saint Albans; Clifford O. Morgan, III, Burlington, both of VT (US); Cong Wei, Poughkeepsie, NY (US)

(73) Assignee: International Business Machines Corporation, Armonk, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/129,103

(22) Filed: Aug. 4, 1998

(51) Int. Cl.[7] ..... B24B 49/00; B24B 51/00

(52) U.S. Cl. ..... 451/5; 451/8; 451/41; 451/287

(58) Field of Search ..... 451/5, 8, 10, 41, 451/285–289

(56) References Cited

U.S. PATENT DOCUMENTS

| | | | | |
|---|---|---|---|---|
| 5,036,015 | * | 7/1991 | Sandhu et al. | 437/8 |
| 5,245,794 | * | 9/1993 | Salugsugan | 51/165.74 |
| 5,595,526 | * | 1/1997 | Yau et al. | 451/8 |
| 5,639,388 | * | 6/1997 | Kimura et al. | 216/84 |
| 5,643,050 | * | 7/1997 | Chen | 451/10 |
| 5,659,492 | * | 8/1997 | Li et al. | 364/569 |
| 5,667,629 | * | 9/1997 | Pan et al. | 438/13 |
| 5,672,091 | * | 9/1997 | Takahashi et al. | 451/6 |

* cited by examiner

*Primary Examiner*—Lee Young
*Assistant Examiner*—Rick Kiltae Chang
(74) *Attorney, Agent, or Firm*—Alison D. Mortinger; Jay H. Anderson

(57) ABSTRACT

Determination of an endpoint for removing a film from a wafer, by determining a first reference point removal time indicating when a breakthrough of the film has occurred, determining a second reference point removal time indicating when the film has been polished almost to completion, determining an additional removal time indicating an over-polishing interval, and adding the second reference point removal time with the additional removal time to get a total removal time to the endpoint.

35 Claims, 1 Drawing Sheet

CHEMICAL MECHANICAL POLISHING ENDPOINT PROCESS CONTROL

FIELD OF THE INVENTION

This invention is directed to in-situ endpoint detection for chemical mechanical polishing of semiconductor wafers, and more particularly to a system for data acquisition and control of the chemical mechanical polishing process.

BACKGROUND OF THE INVENTION

In the semiconductor industry, chemical mechanical polishing (CMP) is used to selectively remove portions of a film from a semiconductor wafer by rotating the wafer against a polishing pad (or rotating the pad against the wafer, or both) with a controlled amount of pressure in the presence of a chemically reactive slurry. Overpolishing (removing too much) or underpolishing (removing too little) of a film results in scrapping or rework of the wafer, which can be very expensive. Various methods have been employed to detect when the desired endpoint for removal has been reached, and the polishing should be stopped. One such method described in U.S. Pat. No. 5,559,428 entitled "In-Situ Monitoring of the Change in Thickness of Films," assigned to the present assignee, uses a sensor which can be located near the back of the wafer during the polishing process. As the polishing process proceeds, the sensor generates a signal corresponding to the film thickness, and can be used to indicate when polishing should be stopped.

Generating the signal and using the signal to control the CMP process for automatic endpoint detection are two different challenges, however. During polishing, different conditions may arise which can result in the signal falsely indicating that the endpoint has been reached. For example, the film can be locally non-planar (i.e. "cupped") under the sensor, or the film can be multi-layered (i.e. one type of metal over another). In each of these cases, the change in thickness of the film may not be constant and can even stop for a while under the sensor, so that a false endpoint can be detected. Another issue arises due to the fact that while a single sensor can respond to the thickness of a film in the immediate vicinity, it cannot directly monitor the entire film area on the wafer. Thus a certain amount of overpolishing is necessary to ensure that the entire film has been polished, and a way to determine the correct amount of overpolishing. In addition, the polishing process should be able to be easily and quickly custom-tailored to polishing different types of films, so that down time between lots is minimized. Finally, operator training should be easy, with minimal scrapping of wafers, and a polishing history for each wafer kept so that problem determination and resolution is simplified.

These challenges were met with a chemical mechanical polishing endpoint process control system described in U.S. Pat. No. 5,659,492, which is incorporated herein in its entirety. This process control system functions well for the type of polishing setup and monitoring described above. However, when used with alternate methods of CMP monitoring, especially CMP processes that (1) have a signal trace with different characteristics (i.e. different flat regions and sloped regions), (2) reach endpoint very quickly, with a small operating window for accuracy, and (3) involve a monitoring setup that reflects polishing across the entire wafer rather than sensing a specific location, the control system lacks accuracy and robustness.

Thus there remains a need for a more accurate and robust system for detecting and determining the endpoint for chemical-mechanical polishing. Such a system should capture reference points (i.e. key points in the signal trace) very quickly as well as be extremely accurate when calculating the overpolish time. It should also be suitable for use in large-scale production including preventing propagation of errors from one wafer to the next.

SUMMARY OF THE INVENTION

It is therefore an object of the present invention to provide an endpoint detection control system which is capable of capturing the true endpoint within a small operating window.

It is a further object to provide an endpoint detection control system which assures the correct amount of overpolishing.

It is yet a further object to provide an endpoint detection system which is suitable for use in large-scale production.

It is another object to provide such a system that has enhanced accuracy and robustness that can be used to control a wide variety of polishing processes.

In accordance with the above listed and other objects, determination of an endpoint for removing a film from a wafer, by determining a first reference point removal time indicating when a breakthrough of the film has occurred, determining a second reference point removal time indicating when the film has been polished almost to completion, determining an additional removal time indicating an overpolishing interval, and adding the second reference point removal time with the additional removal time to get a total removal time to the endpoint is described. Determination of an endpoint for removing a film from a wafer by determining a reference point removal time indicating when the film has been polished almost to completion, determining an additional removal time indicating an overpolishing interval, and adding the reference point removal time, and the additional removal time to get a total removal time to the endpoint is also described.

BRIEF DESCRIPTION OF THE DRAWINGS

These and other features, aspects, and advantages will be more readily apparent and better understood from the following detailed description of the invention, in which.

DESCRIPTION OF THE PREFERRED EMBODIMENTS

Summary of Arrays, Parameters and Calculated Variables

These arrays, parameters and calculated variables are used:

ARRAYS

1) Raw data

Figure 1:
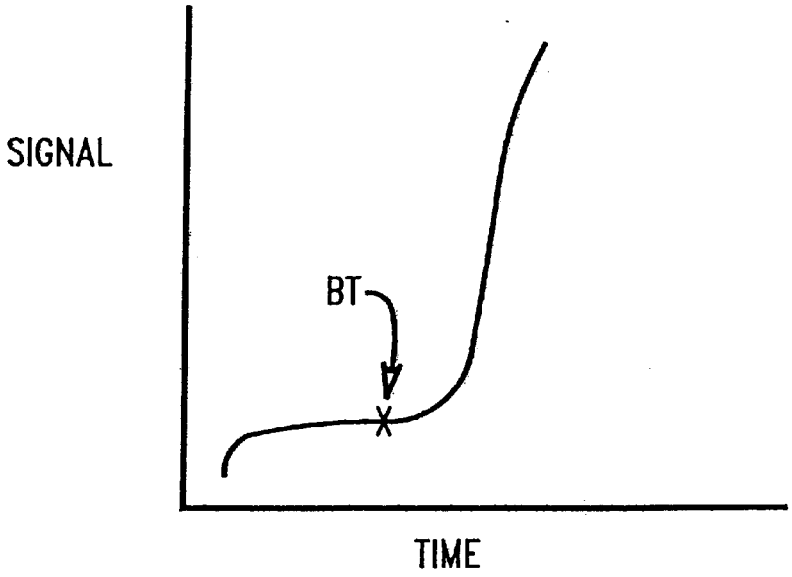
FIG. 1 shows a representative signal versus time trace for endpoint detection.

A moving array containing $N_{raw}$ raw data points from the sensor; averaged to give a single data point on the signal trace (FIG. 1).

2) Reference Point_1

A moving array containing $N_{ref1}$ most recent derivative trace data points; used as an input to the sampling array.

3) Reference Point_2

A moving array containing $N_{ref2}$ most recent derivative trace data points; used as an input to the sampling array 4) Sampling Array A dynamic moving array containing $N_{sample}$ most recent data points based upon the reference point_1 and reference point_2 arrays; used to determine reference points.

PARAMETERS

1) $N_{raw}$

The number of raw data points in the raw data array which are averaged to give a single trace data point.

2) $N_{ref1}$, $N_{ref2}$

The number of derivative trace data points in the reference point arrays.

3) $N_{sample}$

The number of data points in the sampling array.

4) $S_{flat1}$,$S_{flat2}$

The degree of "flatness" acceptable in the sampling array which helps determine whether a reference point has been reached.

5) $S_{incr}$

The degree of increase acceptable in the sampling array which helps determine whether reference point_1 has been reached.

6) $t_{check}$

The time to start searching for a candidate reference point

7) $t_{stop}$

The time at which polishing is stopped if the endpoint has not been detected; used to prevent excessive overpolishing.

8) $Over_{ratio}$

The time for overpolishing past reference point_2 as a percentage of time between reference point_1 and reference point_2.

9) $Over_{fixed}$

The fixed time for overpolishing past reference point_2.

10) $D_{delta}$

The acceptable decrease after reference point_2 in the derivative trace corresponding to a default overpolishing interval.

CALCULATED VARIABLES

1) $S_{max}$, $S_{min}$

The maximum and minimum data points in the sampling array.

Referring now to the drawing, as in the prior endpoint process control system, a signal versus time plot of a signal trace for an exemplary chemical-mechanical polishing endpoint detection is shown in FIG. 1. On the x-axis, time is given in seconds from the start of polishing. On the y-axis, signal output responsive to the polishing process is shown, plotted in real-time on a computer display, along with various other values such as process parameters and settings. Note that although the trace shown has a positive slope, depending on the system setup it may have a negative slope.

Figure 2:
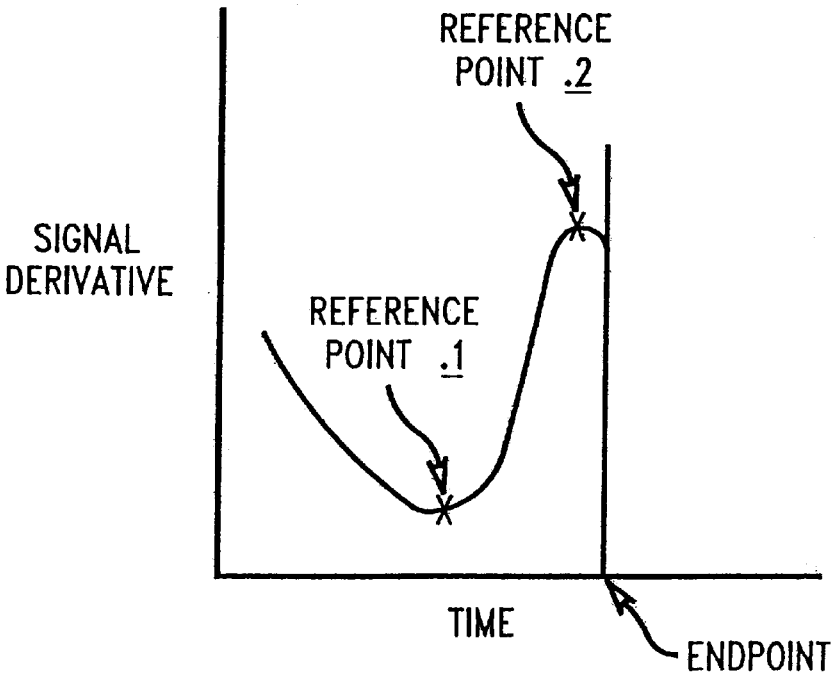
FIG. 2 shows a derivative signal trace; in accordance with the present invention.

In the improved endpoint process control system, a derivative trace is also plotted in real time as shown in FIG. 2, the derivative trace being a mathematical derivative of the signal trace. The derivative trace is used in order to make the change in signal output clearer and easier to monitor.

In the traces shown, the signal change (reflected in both the signal trace and the derivative trace) is proportional to the amount of film that has been polished away to reveal the layer underneath. However, other types of signal output which reflect the change in film thickness from a monitoring scheme are appropriate for this invention as well.

At the start of polishing, there is minimal signal change. When the film has been polished away in one spot (i.e. "breakthrough" has occurred), the signal change associated with the removal of the film will accelerate as more of the underlying film is revealed. In FIG. 1, breakthrough is indicated by BT, which corresponds to reference point_1 in FIG. 2. Polishing is continued until the film is polished to the desired extent (for example until the surface is planar with the topography of the underlying film, so that the film of the first layer being polished is left only in "trenches" on the wafer). At this point, the signal change slows and flattens somewhat. This is very difficult to see in the signal trace shown in FIG. 1; but very apparent in the derivative trace shown in FIG. 2. This point is indicated as reference point_2. Because the polishing rate and the film thickness are not necessarily uniform across the entire wafer, polishing is continued for an extra interval known as "overpolishing," and polishing is stopped at the endpoint indicated at the vertical line. If the film and polishing were uniform across the entire wafer, the overpolishing time could be shortened to zero and the reference point_2 and endpoint would be the same.

In order to have improved accuracy and robustness, a real time CMP endpoint monitoring scheme must detect the endpoint extremely quickly, preferably in less than 1 second. Acquisition of one data point takes a significant portion of 1 second, so to achieve a better signal to noise ratio, signal averaging is necessary. In order to meet the fast endpoint detection requirement, a moving average is plotted in FIG. 1, with each trace data point being the average of a raw data array with the most recent $N_{raw}$ raw data points. In our case, $N_{raw}$=100 is sufficient. Each time a new raw data point is acquired, the oldest raw data point is discarded from the raw data array, the new raw data point added, and a new average calculated and plotted in the trace. Thus a new trace data point is determined every 0.3 to 0.5 seconds. Of course, depending on the polishing conditions (e.g. polishing rate, detection equipment used, quality of the data, etc) the number of raw data points in the raw data array may vary.

As the trace data points are stored in a computer and plotted in the trace shown in FIG. 1, the derivative trace is also plotted in FIG. 2. As the derivative trace is plotted, the system constantly checks to see if a candidate reference point_1 has been reached.

Three arrays are used to test for candidate reference point_1. The first is a reference point_1 array (ref pt_1 array). Like the raw data array, the reference point_1 array is a moving array. The reference point_1 array contains the $N_{ref1}$ most recently acquired derivative trace data points, with $N_{ref1}$ entered as an operating parameter. A typical $N_{ref1}$ for our setup is 10 to 20.

The second array is a reference point_2 array (ref pt_2 array), which is like the reference point_1 array except the $N_{ref2}$ most recently acquired derivative data points is much less. With our setup 3 to 5 is suitable.

The third array is a sampling array, which is a dynamic average of the reference point_1 and reference point_2 arrays. The user determines the weighting between the two arrays. Because the ref_pt 1 array is an average of more points than the ref pt_2 array, the sampling array tend to smooth the data points in the early part of the trace and is more responsive to rapid change in the later part of the trace. The sampling array contains the most recent $N_{sample}$ data points, with $N_{sample}$ being approximately 5–10.

The check performed to see if a candidate reference point_1 has been reached is essentially a test of how "flat" the trace has become. With each new data point added to the sampling array and the oldest discarded, the following comparison is made:

$$S_n - S_{min} \leq S_{flat1} \quad (1)$$

where $S_n$=value of the most recent data point in the sampling array $S_{min}$=minimum value of the data points in the sampling array $S_{flat1}$=operating parameter, acceptable flatness.

Once equation (1) is satisfied, a candidate reference point_1 is detected. To test the trueness of the candidate reference point_1, another comparison is made:

$$S_n - S_{n-1} \geqq S_{incr} \quad (2)$$

where $S_n$=value of the most recent data point in the sampling array, $S_{n-1}$=value of the data point before the most recent data point in the sampling array, and $S_{incr}$=operating parameter, acceptable increase.

After reference point_1, breakthrough has occurred and a substantial increase in the signal would be expected. Equation (2) tests for this increase and if satisfied, the current candidate reference point is the true reference point.

With a typical polishing process, computing equation (1) from the start of polishing may be misleading and inefficient. At the beginning of the trace, strange phenomena may occur, resulting in false data points. One example is if the film is cupped or otherwise not planar so that parts of the film are being polished but others are not. Consideration of these initial false data points can be avoided by letting the process "settle" before reference point checking begins. Equation (1) is thus optionally not calculated until:

$$\text{time} \leqq t_{check} \quad (3)$$

where time=current polishing time $t_{check}$=operating parameter, time to start checking equation (1).

$T_{check}$ is normally set to a value conservatively smaller than the expected reference point.

When equations (1) and (2) satisfied, reference point_1 has been found, and the polishing time to reference point_1 becomes the reference point_1 polishing time.

To determine reference point_2, (ref pt_2) when the film has been polished to the desired extent, the following equation is used:

$$S_n - S_{n-1} \leqq S_{flat2} \quad (4)$$

where $S_n$=value of the most recent data point in the sampling array $S_{n-1}$=value of the data point before the most recent data point in the sampling array $S_{flat2}$=operating parameter, acceptable flatness.

Note that formula (4) is very similar to formula (1); the difference being that a potentially different degree of flatness is used. When polishing is almost complete, the derivative trace will level off as shown and then begin to decrease as removal peaks and slows. The use of other equations to check for the trueness of reference point_2 is not necessary as early fluctuations in the process have already been worked out prior to reference point_1.

After reference point_2 is reached, polishing continues for an interval of overpolishing. The overpolishing interval is determined according to the equation:

$$(t_{ref2} - t_{ref1}) * over_{ratio} + over_{fixed} \quad (5)$$

where $t_{ref1}$=polishing time to reference point_1

$t_{ref2}$=polishing time to reference point_2

$over_{ratio}$=percentage to overpolish $over_{fixed}$=fixed time to overpolish.

If a strictly fixed overpolishing interval is desired, then $over_{ratio}$ is set to zero; if a strict percentage (of the time between reference points) is desired, then $over_{fixed}$ is set to zero; and a mix is also possible with each being non-zero. In practice, $over_{ratio}$ and $over_{fixed}$ are set by the polisher operators within an allowable range based on experience.

The total polishing time to endpoint at the vertical line is thus determined according to:

$$t_{total} = t_{ref2} + (t_{ref2} - t_{ref1}) * over_{ratio} + over_{fixed} \quad (6)$$

where $t_{total}$=endpoint polishing time $t_{ref2}$=polishing time to reference point_2

$t_{ref1}$=polishing time to reference point_1

$over_{fixed}$=percent to overpolish $over_{fixed}$=fixed time to overpolish.

However, as noted above, a maximum polishing time $t_{stop}$ is set to prevent excessive overpolishing. Accordingly, film removal may be stopped if $t_{total}$ exceeds the maximum removal time $t_{stop}$.

Film removal may be stopped if $t_{total}$ exceeds a maximum removal time of $t_{stop}$.

Safety Features

Several precautions are built into the system in case the reference points are not detected. If reference point_1 is not detected but reference point_2 is detected, then the following equation is triggered:

$$t_{def} = t_{ref2} + t_{delta} \quad (7)$$

where $D_{ref2} - D_{current} \geqq D_{delta}$ and $t_{def}$=default endpoint time $t_{ref2}$=polishing time to reference point_2

$t_{delta}$=polishing time of $D_{delta}$; also default overpolishing interval $D_{ref2}$=Y value of the derivative trace at ref pt_2

$D_{current}$=current Y value of the derivative trace $D_{delta}$=operating parameter; minimum decrease in the trace corresponding to a default overpolishing interval.

Plainly stated, since reference point_2 is known but not reference point_1, the overpolishing interval is unknown (since it is a function of the time from reference point_1 to reference point_2). Equation (7) monitors the derivative trace for a certain set decrease (in signal value, or Y value) past reference point_2. Once that set decrease ($D_{delta}$) is reached, the polishing time of that decrease is the default overpolishing interval.

An OR logic is built into the control system to further enhance its robustness. If this option is chosen, the endpoint will be chosen using equation (6) or equation (7), whichever occurs first.

However, the OR logic may be bypassed and equation (7) used along with the following equation:

$$D_{ref2} \geqq D_{height} \quad (8)$$

where $D_{ref2}$=Y value of the derivative trace at ref pt_2

$D_{height}$=operating parameter; expected height of the derivative trace at the true second reference point.

Equations (7) and (8) are used together to choose the endpoint based solely upon reference point_2. This is particularly useful if the signal trace contains "humps" which lead to a false second reference point being identified in the middle of the trace. Thus, the second reference point will not be chosen until the derivative trace reaches an expected height determined from experience running the CMP process.

If neither reference point_1 nor reference point_2 are detected prior to a preset maximum polishing time, then the following equation is triggered:

$$t_{def} = t_{stop} \quad (9)$$

where $t_{def}$=default endpoint time $t_{stop}$=preset maximum polishing time.

Note that polishing can exceed the preset maximum if the reference points have been detected.

Parameter Setting

In order to successfully use the above equations, the parameters must be set correctly. To set the parameters $N_{raw}$, $N_{ref1}$, $N_{ref2}$, $N_{sample}$, $S_{flat1}$, $S_{flat2}$, $S_{incr}$, $t_{check}$, $t_{stop}$, $over_{ratio}$, $over_{fixed}$, $D_{delta}$, and $D_{height}$ so that the true endpoint is successfully determined virtually every time, practice polish runs are required. With our endpoint monitoring system, this is relatively easy to do with our replay mode feature, which minimizes experimentation with product wafers (usually only one test run is required) and results in extremely quick parameter setting during initial system setup.

First, a trace corresponding to the actual CMP process for a real product wafer type must be obtained, i.e. one that leaves no residual film anywhere on the wafer, without unnecessary overpolishing. To get an acceptable trace, a production wafer is polished by an experienced operator/technician with $t_{check}$ and $t_{stop}$ set to a very large number (e.g. 10,000 seconds) so that calculations are not made and polishing will not stop. The trace is monitored by the operator and when it flattens after an expected time has elapsed, polishing is manually stopped. The wafer is cleaned and inspected, and based on experience a reasonable amount of additional polishing time can be determined.

Alternately, $t_{stop}$ can be set to an experienced-based safe value and the wafer is polished to $t_{stop}$, cleaned, and inspected. If the wafer is clean already, another wafer may be polished with an earlier $t_{stpo}$ to avoid excess overpolishing. If the wafer is not completely polished and has residual portions remaining, $t_{stop}$ should be increased for the next polish run. Wafers are polished with different $t_{stop}$ values until the wafer is clean with minimal overpolishing, and an acceptable trace is obtained.

Once the acceptable trace is obtained with either method, no more wafers need to be polished in order to set the process parameters. The trace can be replayed with different values for the parameters to insure that the reference point_1, reference point_2, overpolish interval, and endpoint are reliably and consistently detected. Once the optimal set of parameters is found, they can be stored in a "recipe," and various recipes can be stored and retrieved based on the type of wafer/film being polished.

Closed Loop Processing

With a reference point determining algorithm and the appropriate overpolishing time set, guarded with the absolute stopping time of $t_{stop}$, the endpoint detection system is capable of automatically running the CMP process from start to finish. The system communicates with the sensor and controls the polisher via an interface device through a data acquisition (DAQ) board inside the monitoring computer. When polishing starts, the polisher send a signal to the system, the receipt of which starts data acquisition, display, and decision making. The system then sends a signal to the polisher to stop once the endpoint is reached, and the data trace is saved for future analysis. The polisher can be set up to run wafers in lots, and so the system then waits for the next start signal from the polisher for the next wafer in the lot. Thus an entire lot of wafers can be processed with minimal operator intervention.

Big Loop Control

If the polisher system or the endpoint system malfunctions during polishing (for example the reference points are not detected and equation (8) above is triggered), a "big loop" feature is triggered. Without this feature, polishing of the current wafer is stopped at $t_{stop}$ (a less than optimal result, with a high likelihood of scrapping the wafer), and then the polisher automatically gets another wafer to polish as part of the closed loop processing. The next wafer will likely also be polished to $t_{stop}$. Without operator intervention, this could continue until an entire lot of wafers is polished.

With the big loop feature, once the $t_{stop}$ is triggered, and the current wafer is completed, the control system shuts down the polisher until an operator can fix the problem.

Other Features

Access to various parts of the endpoint detection system are password protected, with separate passwords for the system (machine operator level), data file utilities, recipe creation (engineer level, for parameter setting), and program security.

Polishing of each wafer yields a trace whose data points are saved in a data file. These files can be stored in the endpoint detection system computer or uploaded to a host computer for later study. The data handling portion of the system automatically identifies each wafer and associates it with a wafer lot and recipe used. If process problems occur, then analysis and resolution is much easier.

Note that the use of this type of process control system is not limited to the preferred embodiment, and can be used with a few adjustments to monitor other methods of film removal, for example wet etching, plasma etching, electrochemical etching, ion milling, etc.

While the invention has been described in terms of specific embodiments, it is evident in view of the foregoing description that numerous alternatives, modifications and variations will be apparent to those skilled in the art. Thus, the invention is intended to encompass all such alternatives, modifications and variations which fall within the scope and spirit of the invention and the appended claims.

What is claimed is:

1. A method for determining an endpoint for removing a film from a wafer, comprising the steps of:

determining a first reference point removal time indicating when a breakthrough of the film has occurred;

determining a second reference point removal time indicating when the film has been polished almost to completion;

determining an additional removal time indicating an overpolishing interval; and adding the second reference point removal time, and the additional removal time to get a total removal time to the endpoint, the first and second reference point removal times calculated when a sampling array based upon trace data points is acceptably flat, wherein the first reference point removal time is determined by analyzing the derivative of a signal output responsive to polishing one layer overlying another layer.

2. The method of claim 1 wherein the signal output comprises trace data points, each trace data point being an average of a moving array of raw data points.

3. The method of claim 1 wherein the sampling array is a dynamic average of reference point arrays, the reference point arrays being moving arrays based upon the derivative of the signal output.

4. The method of claim 3 wherein the first reference point removal time is determined when following conditions are met:

$$S_n - S_{min} \leq S_{flat1} \text{ and}$$

$$S_n - S_{n-1} \geq S_{incr}$$

where $S_n$=value of a most recent data point in the sampling array $S_{min}$=minimum value of the data points in the sampling array $S_{flat1}$=operating parameter, acceptable flatness $S_n$=value of the most recent data point in the sampling array, $S_{n-1}$=value of the data point before the most recent data point in the sampling array, and $S_{incr}$=operating parameter, acceptable increase.

5. The method of claim 4 wherein the first reference point removal time is determined when a following condition is also met:

$$\text{time} \geq t_{check}$$

where time=current polishing time, and $t_{check}$=operating parameter; time to start checking for the first reference point.

6. The method of claim 3 wherein the second reference point removal time is determined when the following condition is met:

$$S_n - S_{n-1} \leq S_{flat2}$$

where $S_n$=value of a most recent data point in the sampling array $S_{n-1}$=value of the data point prior to the most recent data point in the sampling array $S_{flat2}$=operating parameter, acceptable flatness.

7. The method of claim 1 wherein the additional removal time is a fixed time greater than or equal to zero.

8. The method of claim 4 wherein the additional removal time is a percent of an interval time between the first reference point removal time and the second reference removal time, greater than or equal to zero.

9. The method of claim 8 wherein the additional removal time is determined according to an equation $$(t_{ref2} - t_{ref1})^* over_{ratio} + over_{fixed}$$

where $t_{ref1}$=polishing time to first reference point $t_{ref2}$=polishing time to second reference point $over_{ratio}$=percentage to overpolish $over_{fixed}$=fixed time to overpolish.

10. The method of claim 1 wherein the endpoint is determined according to an equation $$t_{total} = t_{ref2} + (t_{ref2} - t_{ref1})^* over_{ratio} + over_{fixed}$$

where $t_{total}$=endpoint polishing time $t_{ref2}$=polishing time to second reference point $t_{ref1}$=polishing time to first reference point $over_{ratio}$=percent to overpolish $over_{fixed}$=fixed time to overpolish.

11. The method of claim 10 wherein removal is stopped if $t_{total}$ exceeds a maximum removal time of $t_{stop}$.

12. The method of claim 10 wherein removal is stopped at a default endpoint time determined according to an equation $$t_{def} = t_{ref2} + t_{delta}$$

where $D_{ref2} - D_{current} >= D_{delta}$ and $t_{def}$=default endpoint time $t_{ref2}$=polishing time to second reference point $t_{delta}$=polishing time of $D_{delta}$; also default overpolishing interval $D_{ref2}$=Y value of a derivative trace at second reference point $D_{current}$=current Y value of the derivative trace $D_{delta}$=operating parameter; minimum decrease in the trace corresponding to a default overpolishing interval.

13. The method of claim 1 wherein removal is stopped at an earlier of a default endpoint time determined according to an equation $$t_{def} = t_{ref2} + t_{delta}$$

where $D_{ref2} - D_{current} >= D_{delta}$ and $t_{def}$=default endpoint time $t_{ref2}$=polishing time to second reference point $t_{delta}$=polishing time of $D_{delta}$; also default overpolishing interval $D_{ref2}$=Y value of a derivative trace at second reference point $D_{current}$=current Y value of the derivative trace $D_{delta}$=operating parameter; minimum decrease in the trace corresponding to a default overpolishing interval or an endpoint time determined according to the equation $$t_{total} = t_{ref2} + (t_{ref2} - t_{ref1})^* over_{ratio} + over_{fixed}$$

where $t_{total}$=endpoint polishing time $t_{ref2}$=polishing time to second reference point $t_{ref1}$=polishing time to first reference point $over_{ratio}$=percent to overpolish $over_{fixed}$=fixed time to overpolish.

14. The method of claim 1 wherein the film is removed by chemical-mechanical polishing.

15. A method for determining an endpoint for removing a film from a wafer, comprising the steps of:

determining a reference point removal time indicating when the film has been polished almost to completion;

determining an additional removal time indicating an overpolishing interval; and adding the reference point removal time, and the additional removal time to get a total removal time to the endpoint, wherein the reference point removal time is determined by analyzing a derivative of a signal output responsive to polishing one layer overlying another layer.

16. The method of claim 15 wherein the signal output comprises trace data points, each trace data point being an average of a moving array of raw data points.

17. The method of claim 15 wherein the derivative of the signal output is analyzed.

18. The method of claim 15 wherein the additional removal time is a fixed time greater than or equal to zero.

19. The method of claim 18 wherein removal is stopped at a default endpoint time determined according to equations $$t_{def}=t_{ref2}+t_{delta}$$

where $D_{ref2}-D_{current}>=D_{delta}$ and $t_{def}$=default endpoint time $t_{ref2}$=polishing time to the reference point $t_{delta}$=polishing time of $D_{delta}$; also default overpolishing interval $D_{ref2}$=Y value of a derivative trace at the reference point $D_{current}$=current Y value of the derivative trace $D_{delta}$=operating parameter; minimum decrease in the trace corresponding to a default overpolishing interval; and $D_{ref2} \geqq D_{height}$ where $D_{ref2}$=Y value of the derivative trace at the reference point and $D_{height}$=operating parameter; expected height of the derivative trace at the true second reference point.

20. The method of claim 15 wherein the film is removed by chemical-mechanical polishing.

21. An apparatus for determining an endpoint for removing a film from a wafer, comprising:

means for determining a first reference point removal time indicating when a breakthrough of the film has occurred;

means for determining a second reference point removal time indicating when the film has been polished almost to completion;

means for determining an additional removal time indicating an overpolishing interval; and means for adding the second reference point removal time, and the additional removal time to get a total removal time to the endpoint wherein the first reference point removal time is determined by analyzing a derivative of a signal output responsive to polishing one layer overlying another layer.

22. The apparatus of claim 21 wherein the signal output comprises trace data points, each trace data point being an average of a moving array of raw data points.

23. The apparatus of claim 22 wherein the first, second and additional reference point removal times are determined when a sampling array based upon the trace data points is acceptably flat.

24. The apparatus of claim 23 wherein the sampling array is a dynamic average of reference point arrays, the reference point arrays being moving arrays based upon the derivative of the signal output.

25. The apparatus of claim 24 wherein the first reference point removal time is determined when following conditions are met:

$$S_n-S_{min} \leqq S_{flat1}$$

and $$S_n-S_{n-1} \geqq S_{incr}$$

where $S_n$=value of a most recent data point in the sampling array $S_{min}$=minimum value of the data points in the sampling array $S_{flat1}$=operating parameter, acceptable flatness $S_n$=value of the most recent data point in the sampling array, $S_{n-1}$=value of the data point before the most recent data point in the sampling array, and $S_{incr}$=operating parameter, acceptable increase.

26. The apparatus of claim 25 wherein the first reference point removal time is determined when a following condition is also met:

$$time \geqq t_{check}$$

where time=current polishing time, and $t_{check}$=operating parameter; time to start checking for first reference point.

27. The apparatus of claim 24 wherein the second reference point removal time is determined when a following condition is met:

$$S_n-S_{n-1} \leqq S_{flat2}$$

where $S_n$=value of the most recent data point in the sampling array $S_{n-1}$=value of the data point prior to the most recent data point in the sampling array $S_{flat2}$=operating parameter, acceptable flatness.

28. The apparatus of claim 21 wherein the additional removal time is a fixed time greater than or equal to zero.

29. The apparatus of claim 28 wherein the additional removal time is a percent of an interval time between the first reference point removal time and the second reference removal time, greater than or equal to zero.

30. The apparatus of claim 29 wherein the additional removal time is determined according to an equation $$(t_{ref2}-t_{ref1})*over_{ratio}+over_{fixed}$$

where $t_{ref1}$=polishing time to first reference point $t_{ref2}$=polishing time to second reference point $over_{ratio}$=percentage to overpolish $over_{fixed}$=fixed time to overpolish.

31. The apparatus of claim 21 wherein the endpoint is determined according to an equation $$t_{total}=t_{ref2}+(t_{ref2}-t_{ref1})*over_{ratio}+over_{fixed}$$

where $t_{total}$=endpoint polishing time $t_{ref2}$=polishing time to second reference point $t_{ref1}$=polishing time to first reference point $over_{ratio}$=percent to overpolish $over_{fixed}$=fixed time to overpolish.

32. The apparatus of claim 31 wherein removal is stopped if $t_{total}$ exceeds a maximum removal time of $t_{stop}$.

33. The apparatus of claim 31 wherein removal is stopped at a default endpoint time determined according to an equation $$t_{def}=t_{ref2}+t_{delta}$$

where $D_{ref2}-D_{current}>=D_{delta}$ and $t_{def}$=default endpoint time $t_{ref2}$=polishing time to second reference point $t_{delta}$=polishing time of $D_{delta}$; also default overpolishing interval $D_{ref2}$=Y value of the derivative trace at second reference point $D_{current}$=current Y value of the derivative trace $D_{delta}$=operating parameter; minimum decrease in the trace corresponding to a default overpolishing interval.

34. The apparatus of claim 33 wherein removal is stopped at an earlier of a default endpoint time determined according to an equation $$t_{def}=t_{ref2}+t_{delta}$$

where $D_{ref2}-D_{current}>=D_{delta}$ and $t_{def}$=default endpoint time $t_{ref2}$=polishing time to second reference point $t_{delta}$=polishing time of $D_{delta}$; also default overpolishing interval $D_{ref2}$=Y value of the derivative trace at second reference point $D_{current}$=current Y value of the derivative trace $D_{delta}$=operating parameter; minimum decrease in the trace corresponding to a default overpolishing interval or an endpoint time determined according to an equation $$t_{total}=t_{ref2}+(t_{ref2}-t_{ref1})*over_{ratio}+over_{fixed}$$

where $t_{total}$=endpoint polishing time $t_{ref2}$=polishing time to second reference point $t_{ref1}$=polishing time to first reference point $over_{ratio}$=percent to overpolish $over_{fixed}$=fixed time to overpolish.

35. The apparatus of claim 21 wherein the film is removed by chemical-mechanical polishing.

* * * * *